US007521644B2

(12) United States Patent
Heiko

(10) Patent No.: US 7,521,644 B2
(45) Date of Patent: Apr. 21, 2009

(54) OPERATING MODULE FOR A MOTOR VEHICLE

(75) Inventor: Bald Heiko, Modautal (DE)

(73) Assignee: GM Global Technology Operations, Inc., Detroit, MI (US)

( * ) Notice: Subject to any disclaimer, the term of this patent is extended or adjusted under 35 U.S.C. 154(b) by 166 days.

(21) Appl. No.: 10/589,836

(22) PCT Filed: Jun. 29, 2005

(86) PCT No.: PCT/EP2005/006964

§ 371 (c)(1),
(2), (4) Date: Aug. 17, 2006

(87) PCT Pub. No.: WO2006/005441

PCT Pub. Date: Jan. 19, 2006

(65) Prior Publication Data

US 2007/0163862 A1 Jul. 19, 2007

(30) Foreign Application Priority Data

Jul. 10, 2004 (DE) ..... 10 2004 033 503

(51) Int. Cl.
*H01H 3/42* (2006.01)

(52) U.S. Cl. ..... 200/524

(58) Field of Classification Search ..... 200/294–297, 200/321, 50.02, 524; 174/53–54
See application file for complete search history.

(56) References Cited

U.S. PATENT DOCUMENTS 5,541,379 A * 7/1996 Kim ..... 200/321
5,565,663 A 10/1996 Kossakowski et al.
5,631,454 A * 5/1997 Hubacher et al. ..... 200/296
7,080,889 B2 * 7/2006 Ling et al. ..... 200/50.02

FOREIGN PATENT DOCUMENTS

DE 101 52 452 A1 5/2003

OTHER PUBLICATIONS

International Search Report for PCT/EP2005/06964, mailed Nov. 23, 2005.

* cited by examiner

*Primary Examiner*—Edwin A. Leon
(74) *Attorney, Agent, or Firm*—Ingrassia Fisher & Lorenz, P.C.

(57) ABSTRACT

In a control module for a motor vehicle with an electric switch in a housing, the housing has at least one locking element that can be resiliently deflected, in the locking position of which the housing is secured in the correct position in a seat provided therefore. Each locking element has an associated push button accessible by the user, which cooperates with the locking element in such a way that when it is operated the locking element assumes a release position against its resilient deflection.

9 Claims, 4 Drawing Sheets

OPERATING MODULE FOR A MOTOR VEHICLE

CROSS-REERENCE TO RELATED APPLICATIONS

This application is a U.S. National-Stage entry under 35 U.S.C. § 371 based on International Application No. PCT/EP2005/006964, filed Jun. 29, 2005, which was published under PCT Article 21(2); this application also claims priority under 35 U.S.C. § 119 to German Application No. DE 10 2004 033 503.6, filed Jul. 10, 2004.

FIELD OF THE INVENTION

The invention relates to a control module for a motor vehicle with an electric switch in a housing, which has at least one locking element that can be resiliently deflected, in the locking position of which the housing is secured in the correct position in a seat provided therefore.

Such control modules cannot usually be assembled or disassembled without additional auxiliary tools.

BACKGROUND OF THE INVENTION

U.S. Pat. No. 5,565,663 discloses an electric switch, in which locking elements can be brought into a release position by actuating a function setting that does not occur in normal operation. This function setting is reached by simultaneously pressing or pulling and rotating the switch. While such a switch can be assembled or disassembled without any additional auxiliary tools, its design structure is complicated, and this makes the switch expensive.

BRIEF SUMMARY OF THE INVENTION

It is an object of the invention to provide a control module of the aforementioned type that is easy to assemble or disassemble, can be securely fixed and is, moreover, of simple structure as well as inexpensive.

The object is achieved according to the invention in that each locking element has an associated push button accessible by the user, which cooperates with the locking element in such a way that when it is operated the locking element assumes a release position against its resilient deflection.

A substantial advantage of this solution is that the switch does not undergo any modification, while the push button alone is used to unlock the housing from the seat. In the simplest case, a movable and a rigid locking element are sufficient to secure the housing, wherein the housing tilted on an angle, for example, is inserted into the seat provided for it and locked. The sharing of function between electrical switching and locking results in a simple and inexpensive design of the control module. In an advantageous embodiment, the switch blocks the movement of the at least one locking element out of its locking position and has a defined switching position, in which a movement of the locking element is enabled. This can occur, for example, in the form of a release, which is provided on the switch and in the defined switching position enables a mechanical path of the locking elements. Thus, a combination of push button operation and switching position that is not performed by the user under normal conditions is necessary for assembly or disassembly of the control module. If both hands are necessary for combined control because of the number of push buttons, incorrect operation can be virtually excluded, and therefore a secure attachment of the control module is achieved.

To increase the secure attachment of the control module, the defined switching position of the switch for release of the at least one locking element includes a position, into which the switch is not moved during normal operation of the motor vehicle. In the case of a light switch of a motor vehicle, for example, this can be a switching position differing from the positions of the switch for dip lights, lights off, parking lights or fog lamp etc.

Each push button and each associated locking element preferably form a slide/push connection, which transfers a movement of the push button to the locking element. Since the push button and locking element are usually arranged substantially perpendicular to one another, the specified type of connection represents a particularly simple configuration of a coupling of movement. In this case, the push button and locking element have two associated slide faces for the transfer of movement. The resilient deflection of the locking element can be generated, for example, by a spring mechanism or on the basis of elastic deformation. The push button does not have to be configured in this manner, but can be.

Alternatively, the object is achieved in that each locking element has an associated push button accessible by the user, during operation of which the locking element is released, and the switch cooperates with the locking element in such a way that in a defined switching position the locking element assumes a release position against its resilient deflection.

A substantial advantage of this solution is that while the locking means is movable into a release position by means of the switch, the respective push button is used to unlock the associated locking element. The sharing of function between unlocking of the locking elements and their operation by the switch here also results in a simple and inexpensive design of the control module.

In an advantageous configuration, each push button and each associated locking element form a groove and tongue connection, which is opened upon operation of the push button. Since an elongated rod-shaped element, to which the push button is arranged substantially perpendicular, is normally used as locking element, the specified connection represents a simply designed and easily operated lock for the locking means. The respectively depressed push button therefore enables a mechanical path in the release axis of the locking elements.

In addition, the object is alternatively achieved in that the switch has an associated push button accessible by the user, during operation of which a defined switching position of the switch is enabled, and the switch cooperates with the locking element in such a way that in a defined switching position the locking element assumes a release position against its resilient deflection.

A substantial advantage of this solution is that while the locking means is movable into a release position via the switch, the push button is used to unlock the switch. The sharing of function between unlocking of the switch and operation of the locking elements by the switch in this case also results in a simple and inexpensive design of the control module.

Advantageously, the switch forms a stop with the push button that is opened during operation of the push button. After opening the stop, the switch can be moved into a switching position, in which the locking element assumes a release position and the housing can be removed from the seat. In this case, the stop represents a simply designed and easily operated lock for the switch.

Preferably, an increased force expenditure is necessary to move the electric switch into the defined switching position to release the locking element. This provides further protection from incorrect operation even in the case of two-handed operation of the push buttons and switch, and as a result a secure attachment of the control module is achieved.

The switch is expediently configured as a rotary switch. The torque acting on the rotary knob in this case causes the locking elements to move into the release position of the housing. Projections, which cooperate with the locking elements, can be provided for this on the rotary switch, for example. However, operation of the locking elements by means of a toggle switch is also readily conceivable, in particular using the slide/push connection already mentioned above.

The object is additionally achieved by a corresponding method which firstly relates to the step sequence during unlocking of the locking elements and secondly to the step sequence during unlocking of the electric switch.

It should be understood that the features mentioned above and those still to be explained below are not only usable in the respectively specified combination, but also in other combinations. The framework of the invention is only defined by the claims.

BRIEF DESCRIPTION OF THE DRAWINGS

The invention shall be explained in more detail below on the basis of an embodiment with reference to the associated drawing. Identical parts or similarly acting parts have been given the same reference numerals.

DETAILED DESCRIPTION OF THE INVENTION

The following detailed description of the invention is merely exemplary in nature and is not intended to limit the invention or the application and uses of the invention. Furthermore, there is not intention to be bound by any theory presented in the preceding background of the invention or the following detailed description of the invention.

Figure 1:
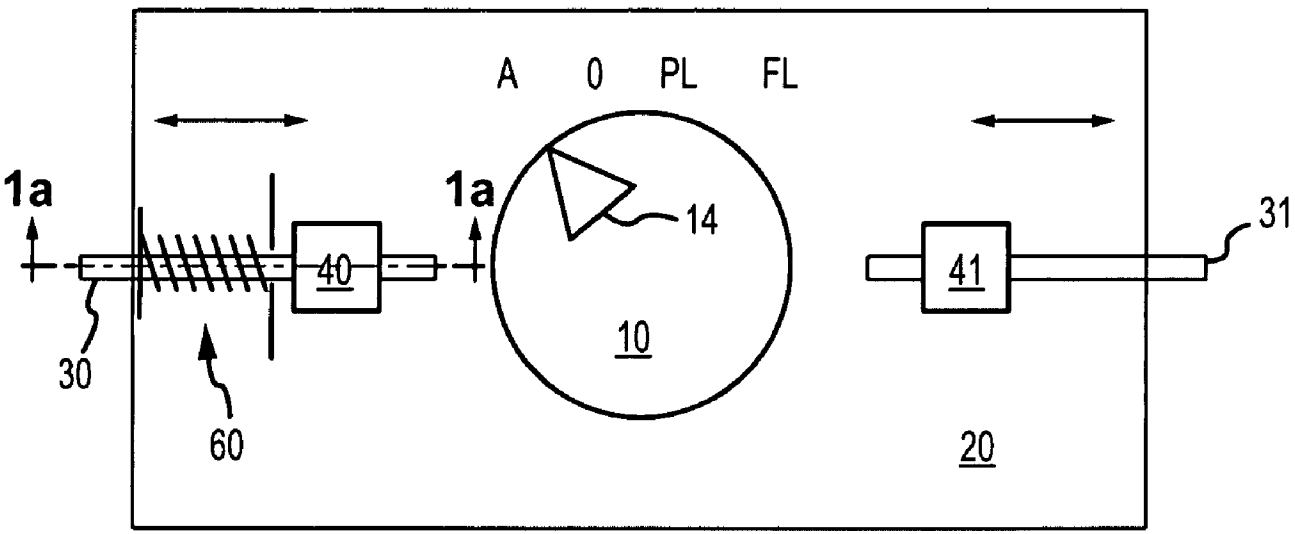
FIG. 1 is a plan view onto a first embodiment of a control module according to the invention.

The control module according to FIG. 1 comprises an electric switch 10 in a housing 20. The switch 10 configured as a rotary switch can be rotated into different switching positions (A, 0, PL, FL), which are displayed accordingly at the switch 10 by means of a marking 14. The housing 20 is secured in the correct position in a seat (not shown) via locking elements 30, 31. By pressing push buttons 40, 41 the associated locking element 30, 31 can be moved into a release position, in which this no longer projects beyond the housing. For this, a slide/push connection 50 is provided between the respective push button 40, 41 and the associated locking element 30, 31.

In the release position of the locking elements 30, 31, the housing 20 can be removed from the seat. To remove the housing 20, the push buttons 40, 41 only need to be pressed simultaneously, as a result of which no modification of the electric switch 10 is necessary and incorrect operation is substantially excluded.

Figure 1A:
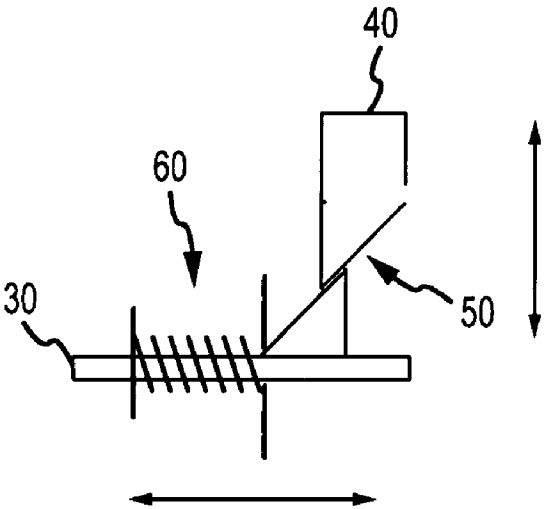
FIG. 1*a* shows a slide/push connection between a push button and a locking element of the control module according to FIG. 1 in direction A-A.

FIG. 1*a* shows the slide/push connection 50 between the push button 40 and the locking element 30 by way of example also for the push button 41 and the locking element 31. When the push button 40 is depressed perpendicularly, the locking element 30 moves against its resilient deflection to the right (release position), otherwise to the left (locking position). For the resilient deflection of the locking element 30, a spring mechanism 60 is provided that presses the locking element 30 into its locking position and for reasons of clarity is always shown only on the left side of the housing 20 in the plan view of this and the following embodiment.

Figure 2:
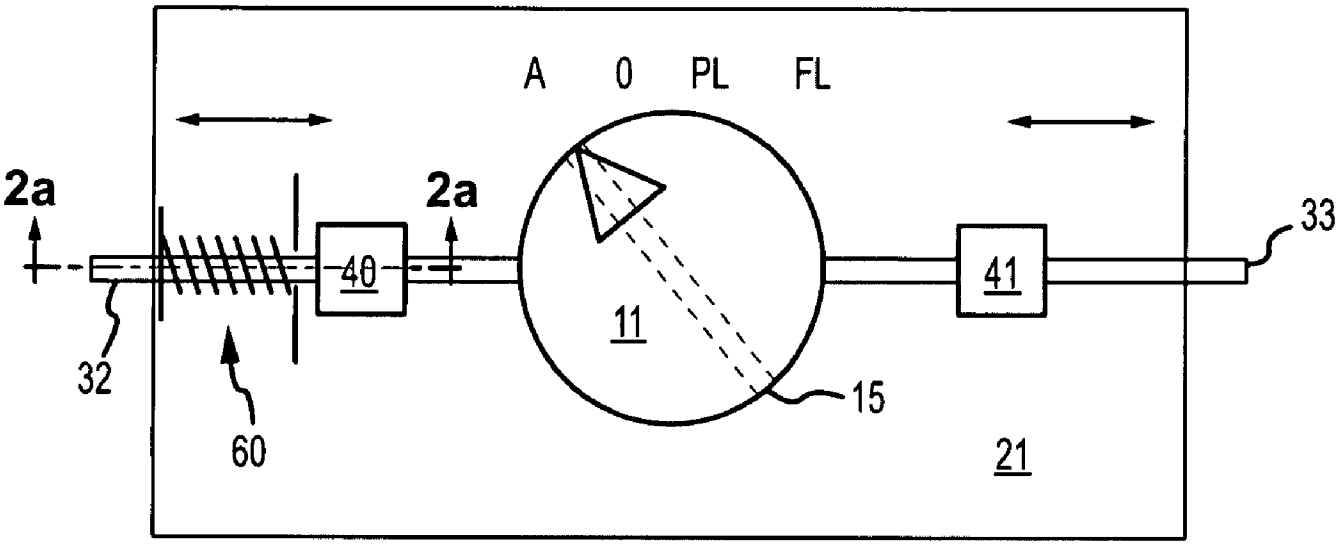
FIG. 2 is a plan view onto a second embodiment of a control module according to the invention.

The control module according to FIG. 2 comprises an electric switch 11 configured as rotary switch in a housing 21, which allows it to rotate into different switching positions (A, 0, PL, FL). The housing 21 is secured in correct position in a seat (not shown) via locking elements 32, 33. By pressing push buttons 40, 41 the associated locking element 32, 33 can be moved into a release position, in which this no longer projects beyond the housing 21. For this, a slide/push connection 50 is provided between the respective push button 40, 41 and the associated locking element 32, 33. However, this release position can only be reached in the switching position of the switch 11, in which a release 15 on the switch 11 enables a mechanical path for the locking elements 32, 33. Otherwise, the movement of the locking elements 32, 33 and therefore the operation of the push buttons 40, 41 is blocked. For this, the locking elements 32, 33 in this embodiment are longer than in that according to FIGS. 1, 1*a*.

In the release position of the locking elements 32, 33, the housing 21 can be removed from the seat. To remove the housing 21, the switch 11 must be rotated into a defined switching position and then the push buttons 40, 41 must be pressed simultaneously, so that one modification of the electric switch 11 is sufficient with a corresponding release 15. As a result, a simple configuration of the electric switch 11 is possible and incorrect operation is substantially excluded.

Figure 2A:
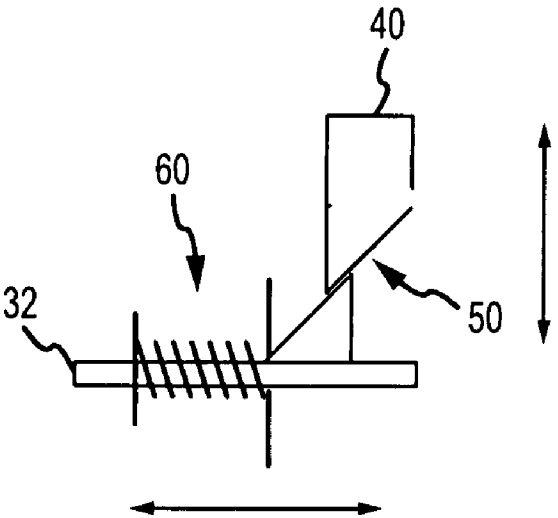
FIG. 2*a* shows a slide/push connection between a push button and a locking element of the control module according to FIG. 2 in direction A-A.

FIG. 2*a* shows the slide/push connection 50 between the push button 40 and the locking element 32 by way of example for the push button 41 and the locking element 33. The principle of operation is fundamentally the same as the principle of operation of the representation according to FIG. 1*a*.

Figure 3:
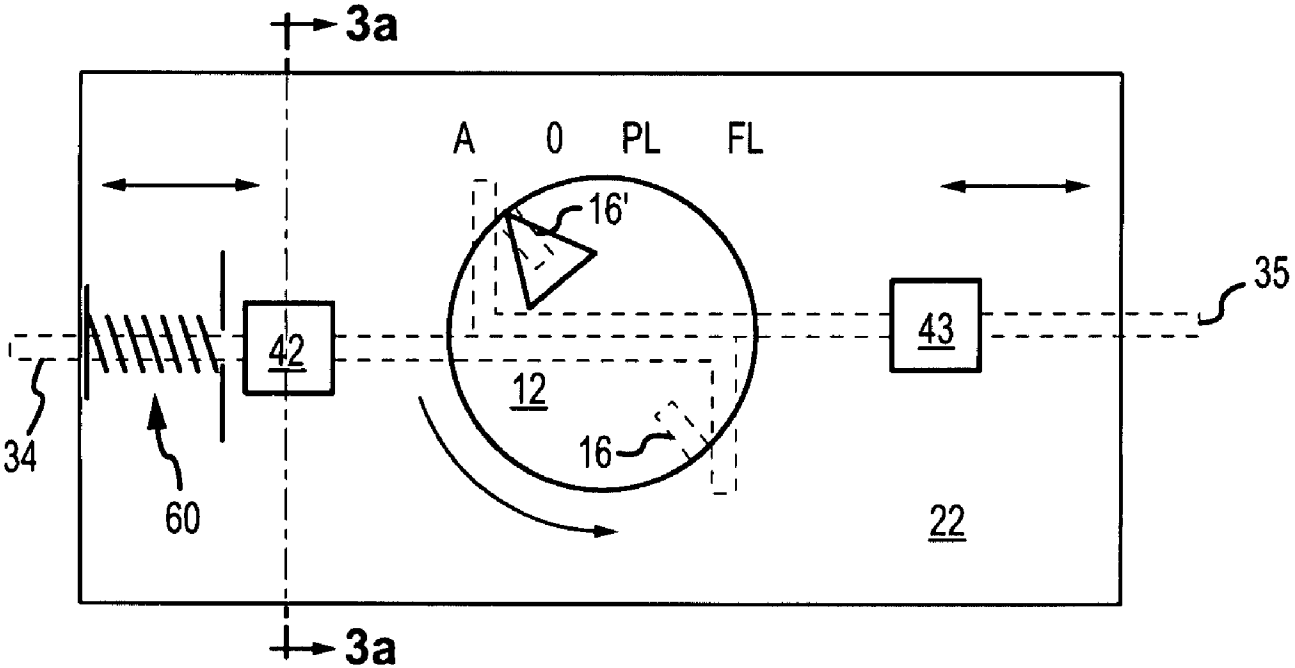
FIG. 3 is a plan view onto a third embodiment of a control module according to the invention.

The control module according to FIG. 3 comprises an electric switch 12 configured as rotary switch in a housing 22. The switch 12 can be rotated into different switching positions (A, 0, PL, FL). The housing 22 is secured in correct position in a seat (not shown) by means of locking elements 34, 35. By pressing push buttons 42, 43 the associated locking element 34, 35 can be unlocked, for which a groove and tongue connection 51 is provided between the respective push button 42, 43 and the associated locking element 34, 35. If both push buttons 42, 43 are operated and the locking elements 34, 35 are unlocked, the switch 12 can be rotated counter-clockwise beyond the switching position A, wherein projections 16, 16' act on angled ends of the locking elements 34, 35 and press these into a release position.

In the release position of the locking elements 34, 35 the housing 22 can be removed from the seat. To remove the housing 22, the push buttons 42, 43 must be pressed simultaneously and then the switch 12 must be rotated, which provides the projections 16, 16' as the only modification. As a result, a simple configuration of the electric switch 12 is possible and incorrect operation is substantially excluded. The resilient deflection of the locking elements 34, 35 by the spring mechanism 60 can be selected so that an increased expenditure of force is additionally necessary for rotating the switch 12.

Figure 3A:
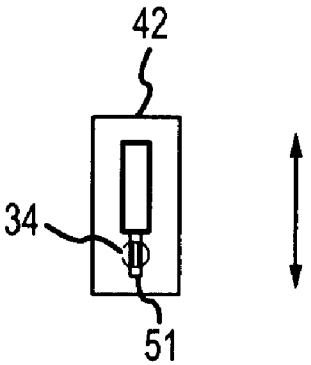
FIG. 3*a* shows a groove and tongue connection between a push button and a locking element of the control module according to FIG. 3 in direction A-A.

FIG. 3*a* shows the groove and tongue connection 51 between the push button 42 and the locking element 34 by way of example for the push button 43 and the locking element 35. When the push button 42 is depressed perpendicularly, the groove and tongue connection 51 is released and the locking element 34 unlocked. As a result, the locking elements 34, 35 can be moved into a release position by rotating the electric switch 12.

Figure 4:
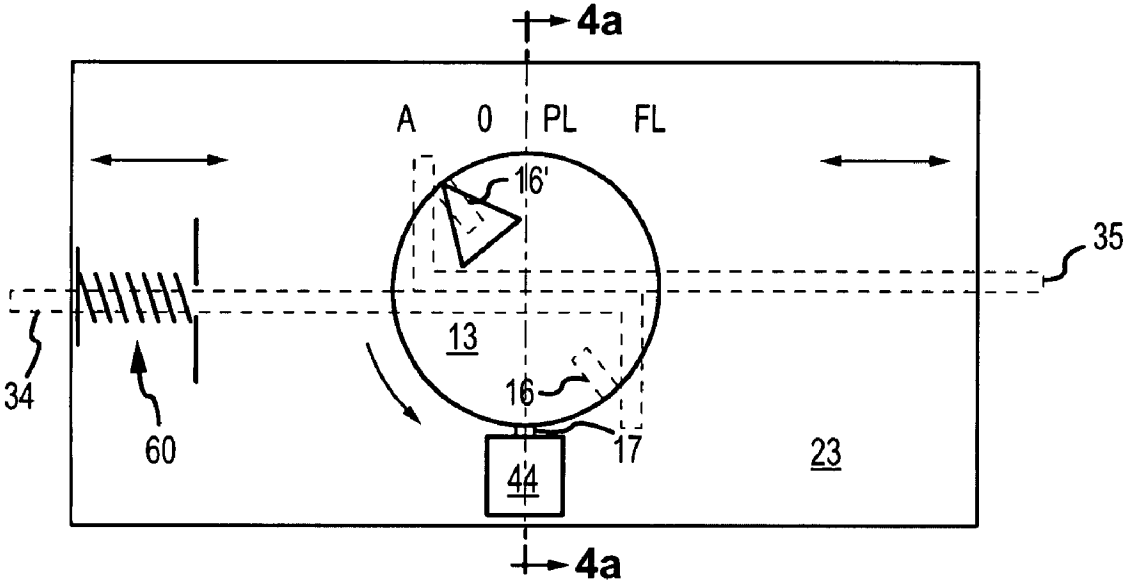
FIG. 4 is a plan view onto a fourth embodiment of a control module according to the invention.

The control module according to FIG. 4 comprises an electric switch 13 configured as rotary switch in a housing 23. The switch 13 can be rotated into different switching positions (A, 0, PL, FL). The housing 23 is secured in correct position in a seat (not shown) by means of locking elements 34, 35. By pressing a push button 44 the switch 13 can be unlocked, for which a lock 17 is provided between the push button 44 and the switch 13. If the push button 44 is operated, the switch 13 can be rotated counter-clockwise beyond the switching position A, wherein the projections 16, 16' act on angled ends of the locking elements 34, 35 and press these into the release position.

In the release position of the locking elements 34, 35 the housing 23 can be removed from the seat. To remove the housing 23, the push button 44 must be pressed and then the switch 13 must be rotated, which the projections 16, 16' and the lock 17 provide as the only modification. As a result, a simple configuration of the electric switch 13 is possible and incorrect operation is substantially excluded. The spring mechanism 60 can also be designed here so that an increased force expenditure is necessary for rotation of the switch 13.

Figure 4A:
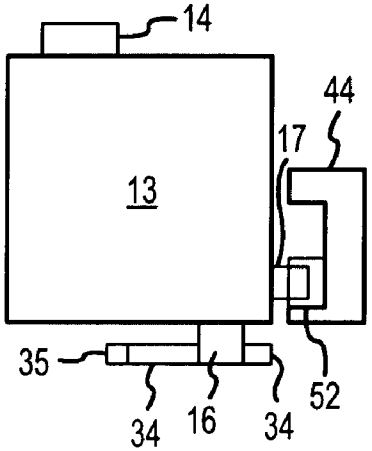
FIG. 4*a* shows a stop of a switch and a push button of the control module according to FIG. 3 in direction A-A.

FIG. 4*a* shows a stop 52 of push button 44 and switch 13. When the push button 44 is depressed perpendicularly, the lock 17 is released from the stop 52 and the switch 13 is unlocked. As a result, the locking elements 34, 35 can be moved into a release position by rotating the switch 12.

The above-described embodiments permit a simple and secure attachment of the control module and in this case are simple in design and also inexpensive. Incorrect operations are practically excluded from the viewpoint of normal operation.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A control module for a motor vehicle, comprising:

a seat coupled to the vehicle;

a housing coupled to the seat;

at least one locking element coupled to the housing that is configured to resiliently deflect, and releasably secure the housing in the seat when the at least one locking element assumes a locking position;

a push button coupled to the at least one locking element, the push button configured to resiliently deflect the locking element into a position that releases the housing; and a switch coupled to the housing, the switch having an opening therein that enables the locking element to move into the release position only when the switch is rotated to a defined switching position.

2. A control module according to claim 1, wherein the defined switching position for release of the locking element includes a position into which the switch is not moved during normal operation of the motor vehicle.

3. A control module according to claim 1, wherein each push button and each associated locking element form a slide/push connection, which transfers a movement of the push button to the locking element.

4. The control module according to claim 1, wherein the switch is configured as a rotary switch.

5. A control module for a motor vehicle, comprising:

a seat coupled to the vehicle;

a housing coupled to the seat;

a switch coupled to the housing;

at least one locking element coupled to the housing and configured to resiliently deflect, and to releasably secure the housing in the seat when the at least one locking element is in a locking position; and a push button coupled to the at least one locking element and configured to unlock the at least one locking element enabling it to be deflected, and wherein the switch is further configured to act upon the at least one locking element and resiliently deflect it into a position that releases the housing.

6. A control module according to claim 5, wherein the push button and locking element form a groove and tongue connection that is released upon operation of the push button.

7. The control module according to claim 5, wherein the locking element is further configured such that an increased force expenditure is necessary to move the switch into the defined switching position to release the locking element.

8. A control module for a motor vehicle, comprising:

a seat coupled to the vehicle;

a housing coupled to the seat;

a switch coupled to the housing;

at least one locking element coupled to the housing and configured to resiliently deflect and releasably secure the housing in the seat when the at least one locking element is in a locking position; and a push button configured to unlock the switch enabling it to rotate, and wherein the switch is further configured to resiliently deflect the at least one locking element to a release position and release the housing.

9. A method for releasing a vehicular control module from a seat, the control module having a housing with a switch, wherein the housing has at least one resiliently deflectable locking element, and wherein the locking element is prevented from deflecting into a release position when a groove and tongue connection is engaged, the groove and tongue connection having a pushbutton actuator, the method comprising the steps of:

releasing the groove and tongue connection by depressing the pushbutton actuator; and moving the switch into a defined switching position to resiliently deflect the locking element into a release position.

* * * * *